US005154894A

United States Patent [19]

MacFarlane et al.

[11] Patent Number: 5,154,894

[45] Date of Patent: Oct. 13, 1992

[54] VARIABLE CROSS SECTION CATALYTIC CONVERTER

[75] Inventors: Glen R. MacFarlane, Clarkston; Jordan R. Lee, Sterling Heights; Ronald J. Cantrell, Belleville, all of Mich.

[73] Assignee: General Motors Corporation, Detroit, Mich.

[21] Appl. No.: 747,065

[22] Filed: Aug. 19, 1991

[51] Int. Cl.[5] ..... B01D 50/00; F01N 3/00

[52] U.S. Cl. ..... 422/180; 422/181; 422/221; 422/222; 422/171; 60/288; 60/290; 60/299

[58] Field of Search ..... 422/221, 222, 311, 312, 422/177, 171, 180, 181, 107, 110, 114, 115; 60/288, 290, 299; 55/DIG. 30

[56] References Cited

U.S. PATENT DOCUMENTS

| | | | |
|---|---|---|---|
| 3,287,899 | 11/1966 | Bintz | 60/299 |
| 3,361,350 | 1/1968 | Genbauffe | 236/87 |
| 3,814,589 | 6/1974 | Heitland | 422/115 |
| 3,954,418 | 5/1976 | Stormont | 422/115 |
| 4,023,360 | 5/1977 | Wössner et al. | 60/277 |

*Primary Examiner*—Lynn M. Kummert
*Assistant Examiner*—Christopher Y. Kim
*Attorney, Agent, or Firm*—Karl F. Barr, Jr.

[57] ABSTRACT

A catalytic converter for use in the exhaust system of an internal combustion engine having a rigid outer canister with a catalyst support disposed therein for movement between a first position adjacent in inlet end of the canister and a second position located in spaced relationship with said inlet end. In its first position, the substrate seals the inlet thereby forcing the entire exhaust flow through the fluid flow passages within the catalyst support which are in axial alignment with the converter inlet. The effect of forcing the totality of flow reduced volume of the substrate to the entire thermal energy of the exhaust stream thereby assisting in a reduction in the catalyst light-off time. Following catalyst light-off, the catalyst support is moved to its second, spaced position in which the entire frontal area of the converter is exposed to the exhaust flow thereby lowering backpressure of the converter and preventing converter overtemperature problems.

7 Claims, 2 Drawing Sheets

VARIABLE CROSS SECTION CATALYTIC CONVERTER

BACKGROUND OF THE INVENTION

Field of the Invention

The present invention is directed to an exhaust treatment apparatus for use in the exhaust system of an internal combustion engine and, in particular, to a catalytic converter having means for varying the cross section of the catalyst substrate to reduce the time to converter light-off.

Typical automotive vehicle exhaust systems, and an increasing number of non-automotive applications incorporating internal combustion engines, utilize catalytic converters in the exhaust system for reducing the quantity of regulated constituents emitted to the atmosphere. Common configurations consist of ceramic or metal foil catalyst coated monoliths enclosed in a rigid, stainless steel canister which is interposed within the exhaust system in an underbody location.

As a precondition to the efficient conversion of gas emitted from the engine, the catalyst must reach a minimum operating temperature generally referred to as the light-off temperature. As emission regulation has become increasingly stringent, the reduction of untreated exhaust gas emitted prior to light-off of the converter has become increasingly important.

One method of achieving lower light-off times is through the use of a small "pup" converter which is mounted in close relation to the engine, and is of a relatively small volume when compared to most typical converters. The location and size of the pup converter allows for a relatively rapid catalyst light-off but may adversely affect exhaust system backpressure. Part-time use of the pup converter is generally contemplated with a bypass to direct the exhaust gas to a larger, underbody converter once the larger converter reaches a suitable operating temperature.

SUMMARY OF THE INVENTION

In accordance with the present invention, a catalytic converter is proposed having means for varying the cross section, and hence, the volume of the catalyst substrate to assist in reducing catalyst light-off times. The converter comprises a rigid outer shell having truncated end portions with an inlet and an outlet for conducting exhaust gas therethrough. An axially movable catalyst coated substrate is disposed within the outer shell and has a frontal face generally parallel to the truncated inlet end of the canister. A substrate extension projects outwardly from the frontal face and is configured to sealingly engage the opening of the canister inlet thereby forcing all of the exhaust gas entering the converter to flow through a small volume portion of the converter having a cross section equivalent to the inlet of the canister when the extension is engaged therein. During operation, the catalyst substrate is moved axially forward, towards the entrance end of the canister, until the substrate extension is in sealing engagement with the inlet of the canister and all of the exhaust gas entering the converter is passing through that portion of the substrate which is located in axial alignment with the inlet. As a result, the full thermal energy contained in the exhaust gas impinges on a relatively small area of the substrate thereby helping reduce the time to light-off of that portion of the converter. Once the catalyst reaches a desirable operating temperature, the substrate is moved axially away from the inlet of the canister to allow the exhaust gas entering the converter to flow through the entire substrate thereby reducing catalytic converter backpressure and avoiding overtemperature conditions in the reduced volume central portion.

Movement of the catalyst support may be achieved through the use of a computer controlled stepper motor, or other suitable driver-motor combination, which extends into the canister and acts on the catalyst support. In order that the support is able to move freely without exhaust gas leakage around the perimeter thereof, a seal member may extend between the outer surface of the substrate and the inner surface of the canister.

The present invention provides a catalytic converter configuration which dispenses with the need for a separate, quick light-off converter and associated bypass assemblies which channel exhaust gas around the quick light-off converter to the standard converter after light-off temperatures have been reached. The use of a movable catalyst substrate allows the frontal area to be varied, thereby varying the volume of the converter and enhancing the light-off performance of the unit.

Other objects and features of the invention will become apparent by reference to the following description and to the drawings.

DESCRIPTION OF THE PREFERRED EMBODIMENT

Figure 1:
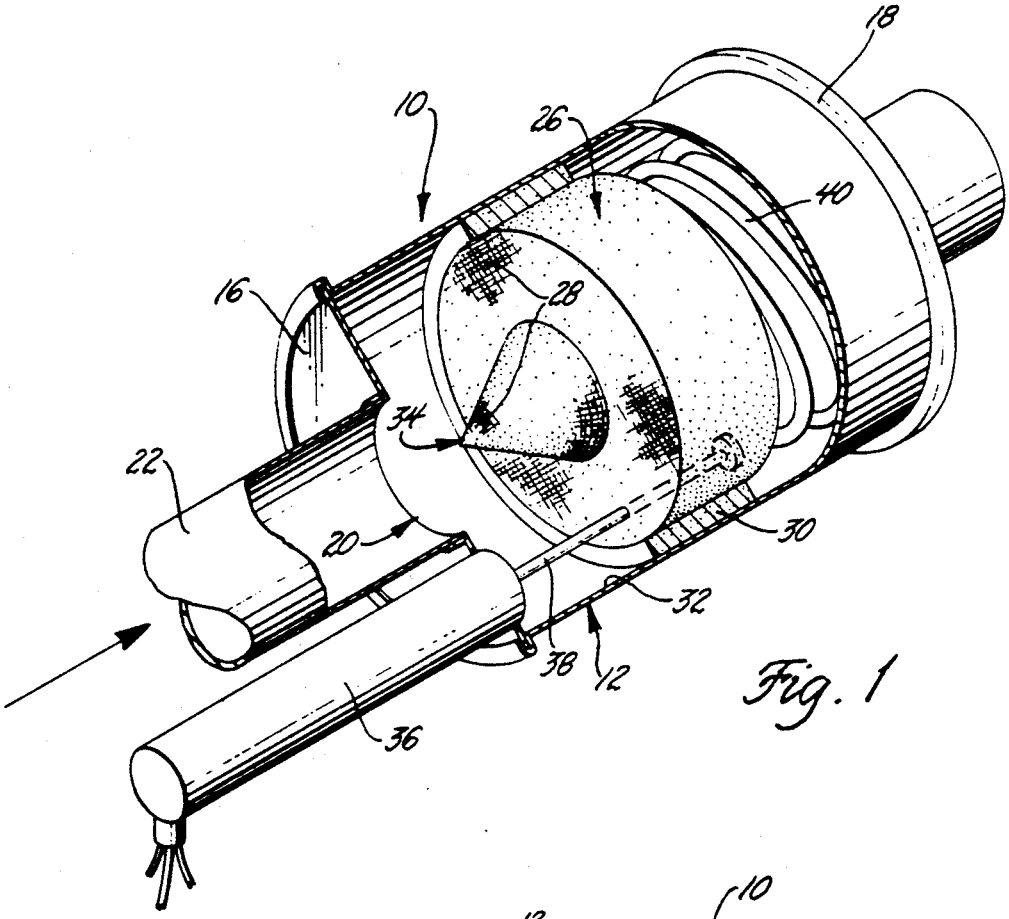
FIG. 1 is a perspective view, partially in section, of a catalytic converter embodying the present invention.

In FIG. 1 there is shown a catalytic converter, designated generally as 10, useful for reducing the quantity of regulated exhaust constituents in the exhaust gas of an internal combustion engine. The converter 10 comprises a canister 12 which, in a preferred embodiment, is a cylindrical outer shell 14 having truncated portions 16 and 18. The canister components are constructed of stainless steel or other suitably rigid and durable materials. An inlet 20 is formed in truncated end portion 16 and is configured to facilitate coupling of the converter to the exhaust system 22 of an internal combustion engine (not shown). In a similar fashion, outlet 24 is formed in truncated end portion 18 and cooperates with the inlet 20 to conduct exhaust gas through converter 10.

Disposed within canister 10 is catalyst support or substrate 26. The substrate may be of any conventional construction, such as extruded ceramic or metal foil, having axially extending fluid flow passages 28 extending therethrough. A catalyst coating is applied to the interior surfaces of the axial passages 28 for reacting with the exhaust gas passing through the substrate 26.

Figure 2:
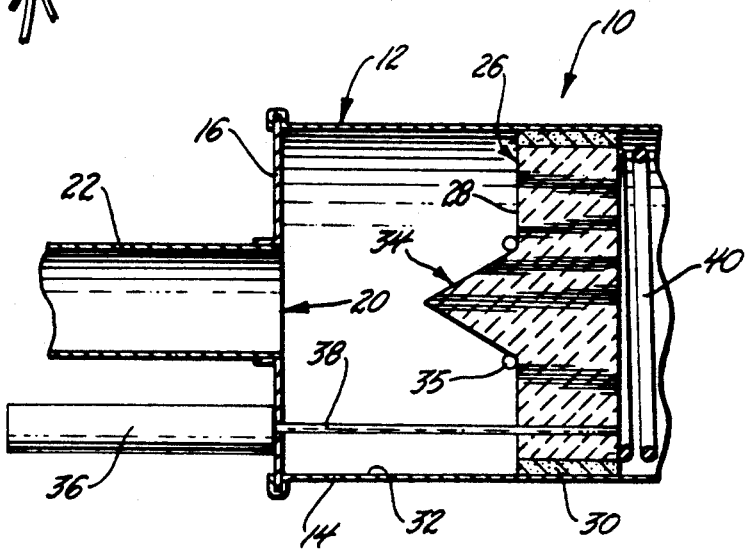
FIG. 2 is a partial side sectional view of the catalytic converter of FIG. 1.

A preferably rigid sealing member 30 is disposed between the outer surface of substrate 26 and the inner surface 32 of cylindrical outer shell 14. A material having reduced frictional characteristics such as ceramic or steel impregnated with graphite or polytetrafloroethylene (PTFE) is preferred for sealing member 30 thereby allowing it to act as a bearing member between the substrate 26 and the shell inner surface 32. With the sealing member 30 in place, the substrate 26 is movable in the axial direction within canister 12, as illustrated in FIGS. 2 and 3, without excessive leakage of exhaust gas around the outer surface of substrate 26.

In a preferred embodiment of the present invention, catalyst support 26 has an extended portion formed on the inlet end thereof, such as the conical portion 34 shown in the Figures. The fluid flow passages 28 of the substrate 26 extend through the conical portion 34 in a similar manner to the main body of the substrate. As shown in FIG. 3, when the catalyst support is moved to a first position adjacent to the inlet 20 of canister 12, the extended conical portion 34 sealingly engages the perimeter of the inlet thereby forcing the entire exhaust gas flow to pass through those fluid flow passages 28 in axial alignment with the inlet opening 20. The effect of channeling the entire flow through a smaller portion of the catalyst substrate is a lowering in catalyst light-off time since the thermal energy of the entire exhaust flow is being applied to a smaller area of the converter. To assure proper sealing between the extended conical portion 34 and the inlet opening 20, and to reduce heat transfer from the catalyst support 26 to the canister 12, an insulative sealing member 35, shown in FIG. 2, may be placed about the base of extended portion 34 so as to be disposed between the support 26 and the perimeter of the inlet when the support 26 is in the first position adjacent to the inlet 20, as described above.

Figure 3:
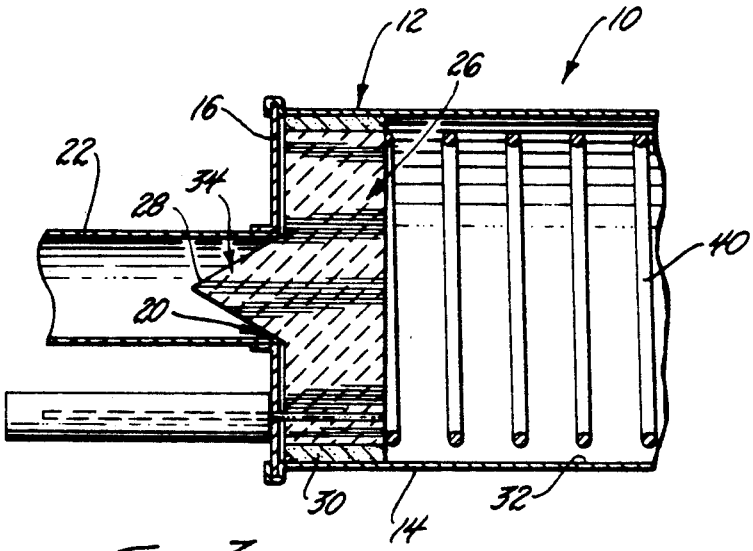
FIG. 3 is a partial side sectional view similar to that of FIG. 2, showing the catalyst support in a second position.

Once the substrate 26 has reached a predetermined temperature it is moved axially away from the inlet, as shown in FIG. 3, to a central position within the canister 12. In this position, the entire frontal area of the catalyst support 26 is exposed to the exhaust gas entering the canister and, as a result, the entire volume of the support 26 is available for the flow of exhaust gas thereby lowering that portion of the exhaust system backpressure which is contributed by the catalytic converter 10 and preventing catalyst overtemperature of the central portion of the support.

The drive assembly for indexing the catalyst support 26 within canister 12 comprises a motor means, such as a linear stepper motor 36, which may be controlled by the engine electronic control module (ECM) or other suitable controller which issues instructions to the motor based on various engine and exhaust system parameters collected from sensors (not shown). The motor 36 drives transfer member 38, which is fixedly attached to the substrate 26, thereby moving the catalyst support to the desired position as determined by the ECM. Biasing means such as return spring 40 may be used to assist the drive motor 36 in moving the substrate 26. Other drive assemblies are contemplated such as that shown in FIG. 4.

Figure 4:
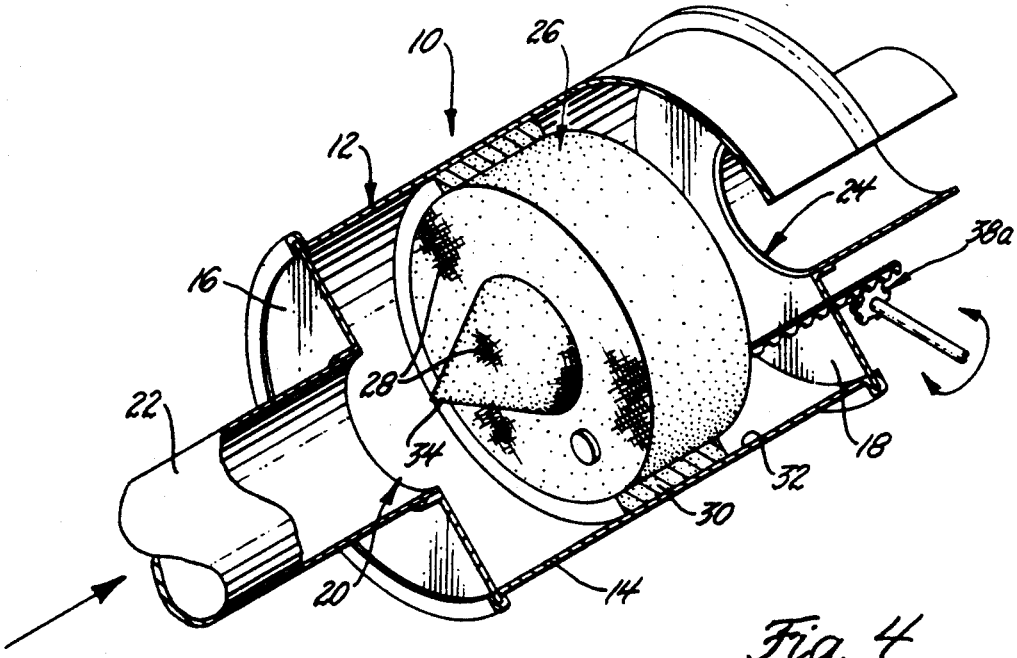
FIG. 4 is a perspective view, partially in section,, of a second embodiment of the converter of FIG. 1.

In the embodiment of FIG. 4, the motor assembly is used to drive a rack and pinion transfer member 38*a* rather than the axially extending rod 38 of the previous embodiment. Furthermore, it is not necessary that the motor means be limited to an electrical device, but may comprise a hydraulic motor or other suitable drive means. Also, it is contemplated that the return spring 40 may reside outside of the canister rather than within the gas stream where it may effect the system backpressure and durability.

The catalytic converter 10 is an efficient solution to multiple converter exhaust systems which utilize small pre-converters in close-mounted configurations for pre-light-off operation, bypassing the exhaust gas to larger, remote converter units for normal temperature operation. Such systems are costly, complex, and are wasteful of precious metals which must be duplicated in both of the converters.

Additionally, should engine operating conditions warrant reengagement of the small portion of the converter, such as may occur during low speed, low load operation during low ambient temperatures, that portion is already at normal operating temperature in the present invention, as opposed to the bypass system in which the smaller, warm-up converter is removed from the exhaust stream during normal temperature operation and is allowed to cool. This provides the potential for quicker reaction to a drop in exhaust system temperature and may improve overall exhaust emissions.

While certain embodiments of the invention have been described in detail above in relation to a catalytic converter, it would be apparent to those skilled in the art that the disclosed embodiment may be modified. Therefore, the foregoing description is to be considered exemplary, rather than limiting, and the true scope of the invention is that described in the following claims.

The embodiments of the invention in which an exclusive property or privilege is claimed are defined as follows:

1. An exhaust gas treatment apparatus comprising a rigid canister having an inlet and an outlet for conducting gas therethrough, a catalyst support disposed within said canister for relative axial movement from a first position in which one end of said catalyst support is located adjacent to said inlet to force exhaust gas entering said converter through a portion of said catalyst support in axial alignment with said inlet and to a second position in which said one end of said catalyst support is located in spaced relationship with said inlet to allow exhaust gas entering said converter to flow through all of said catalyst support, and means for driving said catalyst support between said first and second positions.

2. An exhaust gas treatment apparatus as defined in claim 1, said catalyst support having an extended portion depending from said one end of said catalyst support in alignment with and configured to enter and sealingly engage said inlet opening to conduct exhaust gas through said portion of said catalyst support in axial alignment with said opening.

3. An exhaust gas treatment apparatus as defined in claim 2, said extended portion having a seal member located about the base of said extended portion for disposition between said catalyst support and said inlet opening to minimize exhaust leakage thereabout and to reduce heat transfer from said catalyst support to said canister.

4. An exhaust gas treatment apparatus as defined in claim 1, having a sealing member disposed between the outer surface of said catalyst support and the inner wall of said canister to prevent exhaust gas flow around said catalyst support, said sealing member having frictional characteristics which facilitate movement of said support within said canister.

5. An exhaust gas treatment apparatus as defined in claim 4, said sealing member constructed of a rigid ceramic material.

6. An exhaust gas treatment apparatus as defined in claim 4, said sealing member constructed of graphite impregnated steel.

7. An exhaust gas treatment apparatus as defined in claim 1, said driving means for moving said catalyst support comprising motor means attached to one end of said canister having a drive member passing through the wall of said canister and engaging said catalyst support, an electronic controller for actuating said motor means in response to various engine parameters.

* * * * *